United States Patent [19]

Sanchez

[11] 4,040,179

[45] Aug. 9, 1977

[54] APPARATUS FOR MATING FIRST AND SECOND PORTIONS OF AN ELECTRICAL CONNECTOR

[75] Inventor: Miguel Ruiz Sanchez, Barcelona, Spain

[73] Assignee: AMP Incorporated, Harrisburg, Pa.

[21] Appl. No.: 758,374

[22] Filed: Jan. 11, 1977

[30] Foreign Application Priority Data

Jan. 13, 1976 United Kingdom ..... 01121/76
Apr. 7, 1976 United Kingdom ..... 14018/76

[51] Int. Cl.[2] ..... H01R 43/04
[52] U.S. Cl. ..... 29/749; 29/747; 29/751; 29/816
[58] Field of Search ..... 29/747, 749, 751, 752, 29/753, 811, 816

[56] References Cited

U.S. PATENT DOCUMENTS

| | | | |
|---|---|---|---|
| 3,707,867 | 1/1973 | Mayala | 29/751 X |
| 3,825,987 | 7/1974 | Smith et al. | 29/752 |
| 4,005,516 | 2/1977 | Bakermans | 29/749 |

*Primary Examiner*—Carl E. Hall
*Attorney, Agent, or Firm*—Allan B. Osborne

[57] ABSTRACT

A pistol-type tool for making electrical connections comprises a slide arranged to grip a box-type electrical connector containing slotted plate terminals. The connector is fed into the slide from a magazine with the lid of the connector fully open, the slide is advanced to the forward end of the tool where the connector is loaded with wires manually, a nose member is moved out of the tool body partially to close the lid and is then retracted back into the body, the slide is retracted to position the connector under an open jaw which closes fully to close the lid so as to force the wires into the slots of the terminals in the connector and the jaw is finally opened to allow the connector to be removed from the tool.

15 Claims, 13 Drawing Figures

FIG.5.
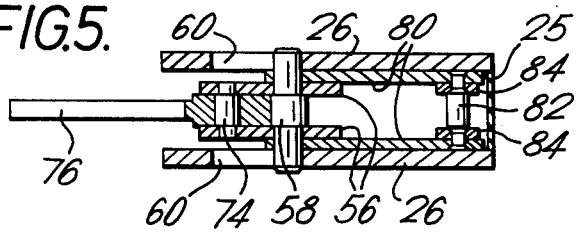
FIG.6.
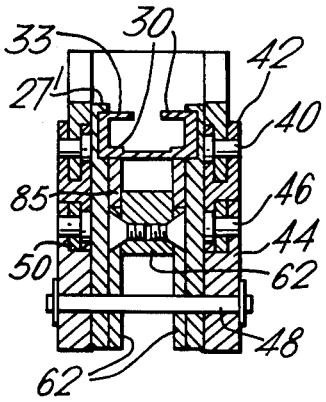
FIG.7.
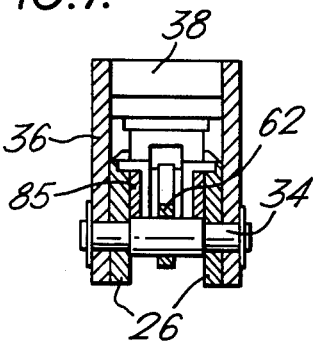
FIG.8.
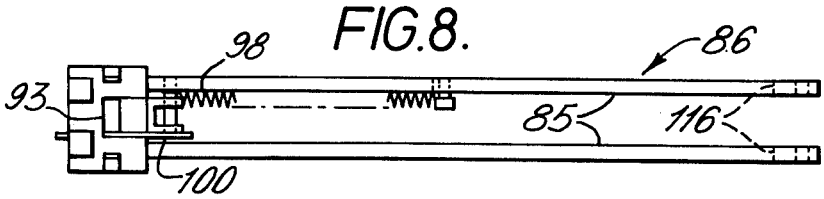
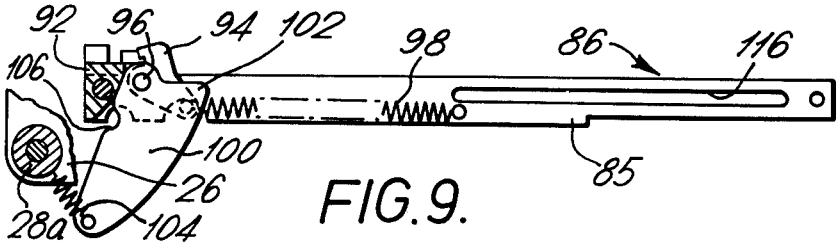
FIG.9.

APPARATUS FOR MATING FIRST AND SECOND PORTIONS OF AN ELECTRICAL CONNECTOR

BACKGROUND OF THE INVENTION

The invention relates to apparatus for terminating wires by means of an electrical connector comprising first and second portions which can be mated to terminate a wire previously placed between the portions. Such a connector is described for example in our U.S. Pat. No. 3,835,444. The connector is in the form of an insulating box containing a slotted plate terminal. The box has a lid which can be closed from a fully open position at right-angles to the adjacent wall of the box to force one or more wires, which have previously been positioned across the box with the aid of wire guiding means thereof, into the slots of the slotted plate terminal since the wires must be forced fully home into the slots if a satsifactory electrical connection is to be made, the lid closure force is necessarily high. Since this connector is used in particular for splicing the wires of telephone cables, of which wires there may be several hundred in a single cable, it is of there may be several hundred in a single cable, it is of importance that the apparatus should be capable of rapid application of the connectors and should be simple to use, especially at an inconvenient site such as manhole or an overhead platform, at which sites telephone cable splicing operations are usually carried out.

Tools for mating two portions of an electrical connector to terminate a wire are described in U.S. Pat. Nos. 3,707,867 and 3,825,987. However, these connectors are in each case supplied to the tool with the two portions of the connector secured in superposed relationship so that all that is required of the tool is to force the two portions together when wires to be spliced have been inserted between the portions.

U.S. Pat. Nos. 3,314,214, 3,511,026 and 3,699,744 disclose apparatus for closing a carton (for containing eggs) in the form of a box having a lid hinged thereto. The lid of the box is closed finally by forcing the box with the lid partially open, beneath a ramp or a resilient pressure member, this being of effect since the carton has but a low closure force. Such apparatus would also be unsuitable for handling connectors of the kind mentioned above, these being only of some $10 \times 5 \times 5$ mm. in size.

Other prior art which is peripheral, so far as the present invention is concerned is represented by the disclosure of U.S. Pat. Nos. 2,942,269; 3,003,376; 3,527,075; 3,578,935 and 3,965,558, as well as German Patent Specification No. 2,538,558.

BRIEF STATEMENT OF INVENTION

It is a primary purpose of the invention to provide apparatus for mating first and second portions of an electrical connector to connect a terminal therein to a wire placed between the portions, which apparatus is simple and expeditious in use.

It is a second purpose of the invention to provide such apparatus in which the connector is exposed for loading with wire at a position on the apparatus where the linesman's view of the connector is unobstructed.

It is a third purpose of the invention to provide such apparatus which is fully automatic apart from the operation of loading the connector with wire.

It is a fourth purpose of the invention to provide such apparatus which can readily be constructed in the form of a piston-type tool actuated by manual trigger means, so that no power supply for the tool is required.

It is a fifth purpose of the invention to provide such apparatus in which the parts are automatically returned to their initial positions after the apparatus has been actuated to make an electrical connection.

It is a sixth purpose of the invention to provide such apparatus in which the connector can easily be removed therefrom after the wires have been terminated.

STATEMENT OF THE INVENTION

According to one aspect of the invention, apparatus for mating first and second portions of an electrical connector to connect a terminal therein to a wire placed between the portions, comprises a support for the first portion, a jaw, means for moving the jaw from a raised position remote from the support, towards the support, to move the second portion into mating relationship with the first portion, means for displacing the support from a first position remote from the jaw to a second position in register with the jaw when the jaw is in its raised position, and means for positioning the second portion with respect to the jaw prior to the support reaching its second position, to enable the jaw to move the second portion into mating relationship with the first portion.

Since in the first position of the support, the support is remote from the jaw, one or more wires can, according to a preferred embodiment of the invention, readily be loaded by the operator of the apparatus into the first portion of the connector without the operator being either visually or manually obstructed by the jaw. Also, the first portion of the connector is automatically positioned with respect to the jaw so that the operator has no need to perform this positioning operation.

The apparatus may conveniently be constructed as a pistol-type hand tool for use for example in splicing telephone wires in the field, although it may otherwise be constructed, for example, as a bench mounted tool or machine.

According to another aspect of the invention, a pistol-type tool for mating first and second portions of an electrical connector to connect a terminal therein to a wire placed between the portions, the tool comprising a forward and a rear end, a support for the first portion, a jaw intermediate said forward and rear ends, means for moving the jaw from a raised position to a closed position to move the second portion into mating relationship with the first portion, means for displacing the support rearwardly from a first position and at the forward end of the tool to a second position in register with the jaw when the jaw is in its raised position, and means for positioning the second portion with respect to the jaw prior to the support reaching its second position, to enable the jaw to move the second portion into mating relationship with the first portion as the jaw is moved to its closed position.

The support may comprise a gripper having an open position allowing insertion of the first portion into the gripper, and a closed position in which the second portion is gripped by the gripper, means being provided for bringing the gripper to its open position in the second position of the support, such means also serving to return the jaw to its raised position, means also being provided for feeding a connector into the gripper in the raised position of the jaws and with the gripper in its open position. To enable automatic feeding of the tool a connector feed track may be advanceable towards the support, to an extent limited by a stop, to position a connector in the support when the support is in its second position and the jaw is in its raised position.

The feed track is conveniently advanced by means of a feed member which is slidable in the feed track to engage a row of connectors in the feed track, with connectors frictionally engage the feed track, the engagement of the feed track with the stop causing a connector to be ejected from the feed track into the support.

BRIEF DESCRIPTION OF THE DRAWINGS

For a better understanding of the invention reference will now be made by way of example to the accompanying drawings in which:

FIG. 5 is a sectional view taken on the lines V—V of FIG. 3;

FIG. 6 is a sectional view taken on the lines VI—VI of FIG. 3;

FIG. 7 is a sectional view taken on the lines VII—VII of FIG. 3;

FIG. 8 is a plan view of a slide of the tool;

FIG. 9 is a longitudinal sectional view of the slide;

DETAILED DESCRIPTION OF THE INVENTION

Figure 1:
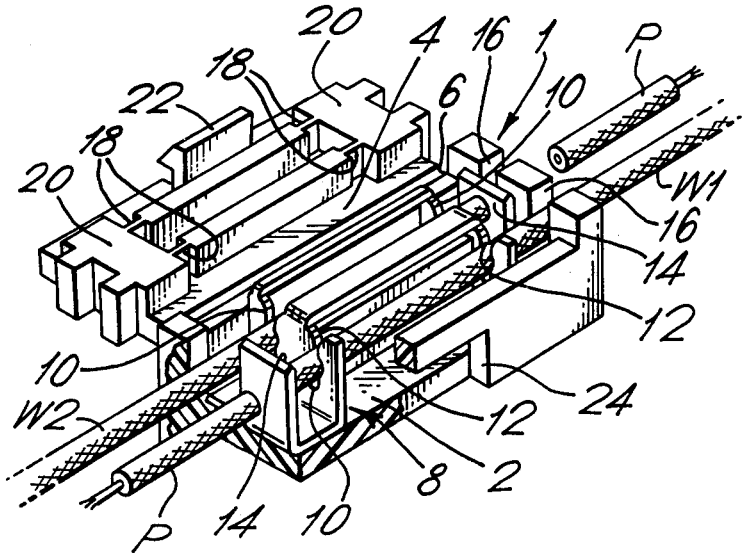
FIG. 1 is an enlarged perspective view, with part broken away, of an electrical connector for splicing a pair of wires which are shown in an assembled position in the connector.

An electrical splice connector 1 shown in FIG. 1 comprises an insulating housing 2 formed as a box and having a lid 4, also of insulating material, and which is pivotally connected to the box 2 by a hinge 6. In the box 2 there is an electrical terminal 8 stamped and formed from sheet metal and presenting two pairs of aligned slots 10 and 12, respectively, each pair of slots having associated therewith a wire cutting blade 14. In order to splice insulated wires W1 and W2 by means of the connector, the wires are laid in guide grooves 16 (only two of which are shown) formed in the box 2 so that the wire W1 is across the mouth of the slots of the aligned pair of slots 10, the wire W2 lying across the mouths of the aligned pair of slots 12. The lid 4 is then closed so that wire stuffer members 18 of ribs 19 on the lid 4 force the wires W1 and into their respective pairs of slots so that the edges of the slots pierce the insulation of the wires and thus make electrical contact with the electrically conductive cores of the wires. During the closure of the lid, end portion P of each wire is severed by cooperation between a wire severing block 20 on the lid 4 and one of the blades 14. The wires are shown in FIG. 1 in the position in which they have been forced into the slots of the terminal 8 and have been severed as mentioned above. When the lid 4 has been fully closed, a resilient latch member 22 on the lid 4 engages in an opening 24 in the box 2 so that the lid 4 is firmly held in its closed position and the wires W1 and W2 are permanently spliced. The interior of the box may be provided with a sealant material (not shown) to preserve the spliced connection against the ingress of moisture.

A tool for use in splicing wires with the aid of connectors according to FIG. 1 will now be described with references to FIGS. 2 to 13.

Figure 2:
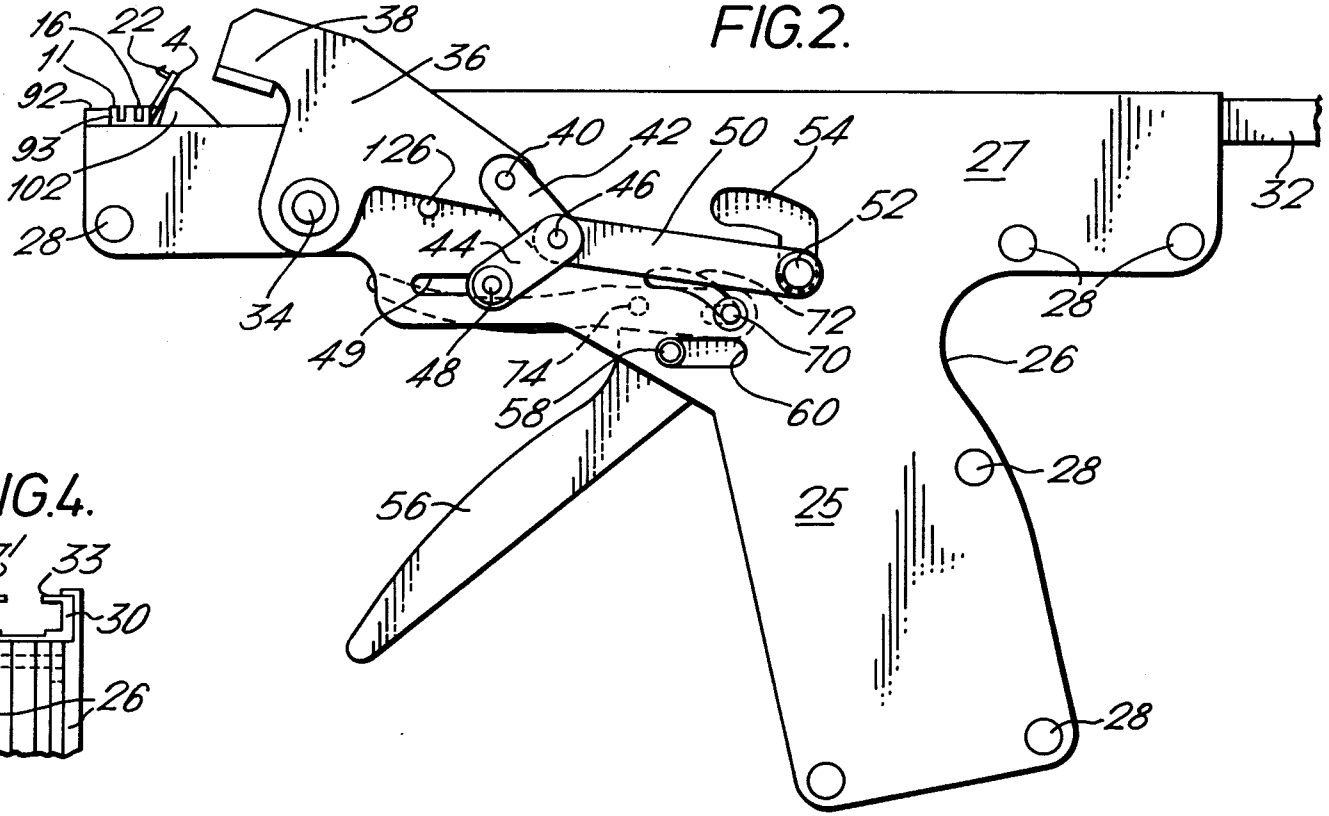
FIG. 2 is a diagrammatic side elevational view of a tool for use in splicing wires with the aid of connectors according to FIG. 1, the tool being shown at a first stage of its cycle of operation.
Figure 4:
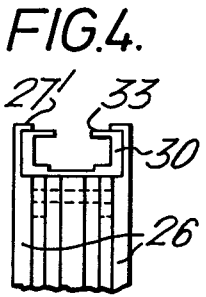
FIG. 4 is a fragmentary, diagrammatic end of the tool with parts removed.
Figure 3:
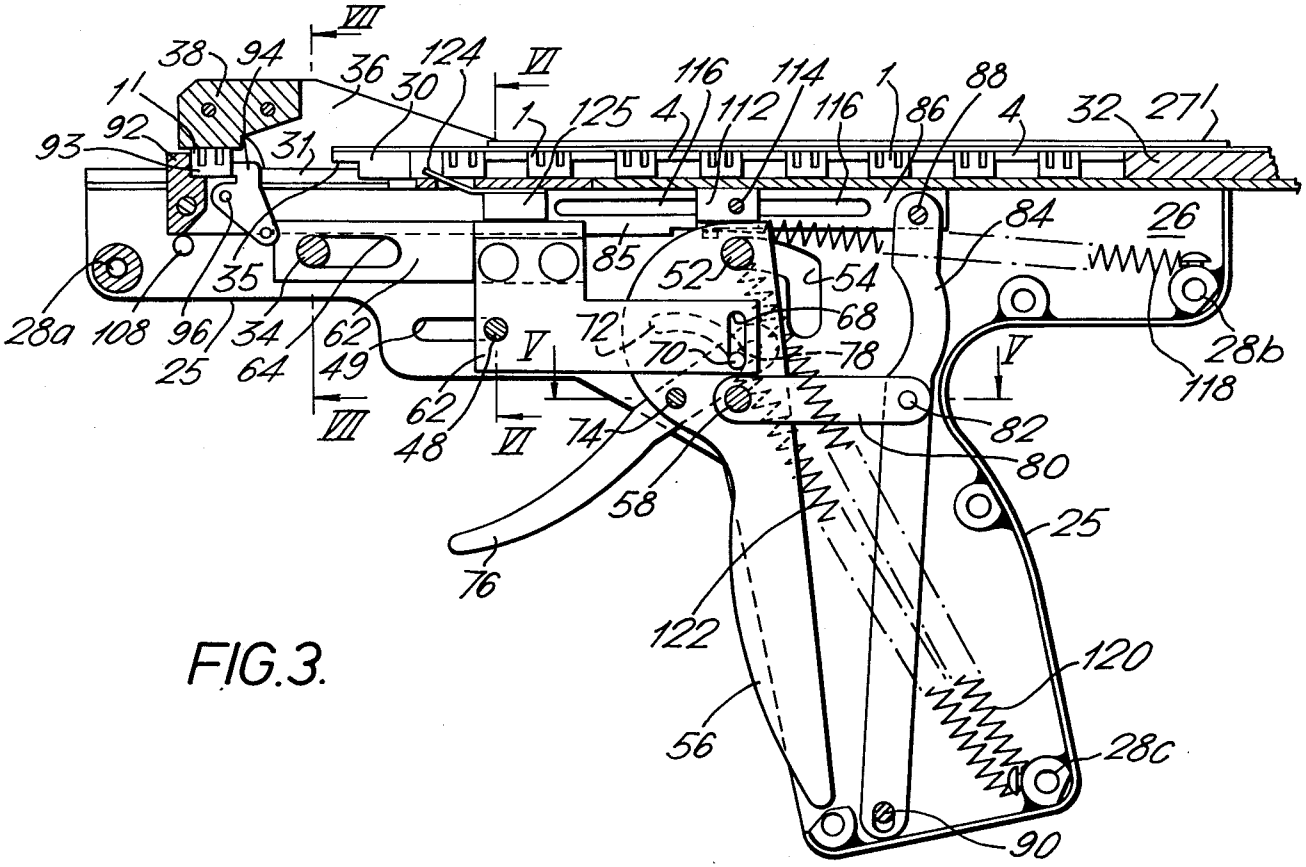
FIG. 3 is a diagrammatic longitudinal sectional view of the tool, the tool being shown at a second stage in its cycle of operation.
Figure 10:
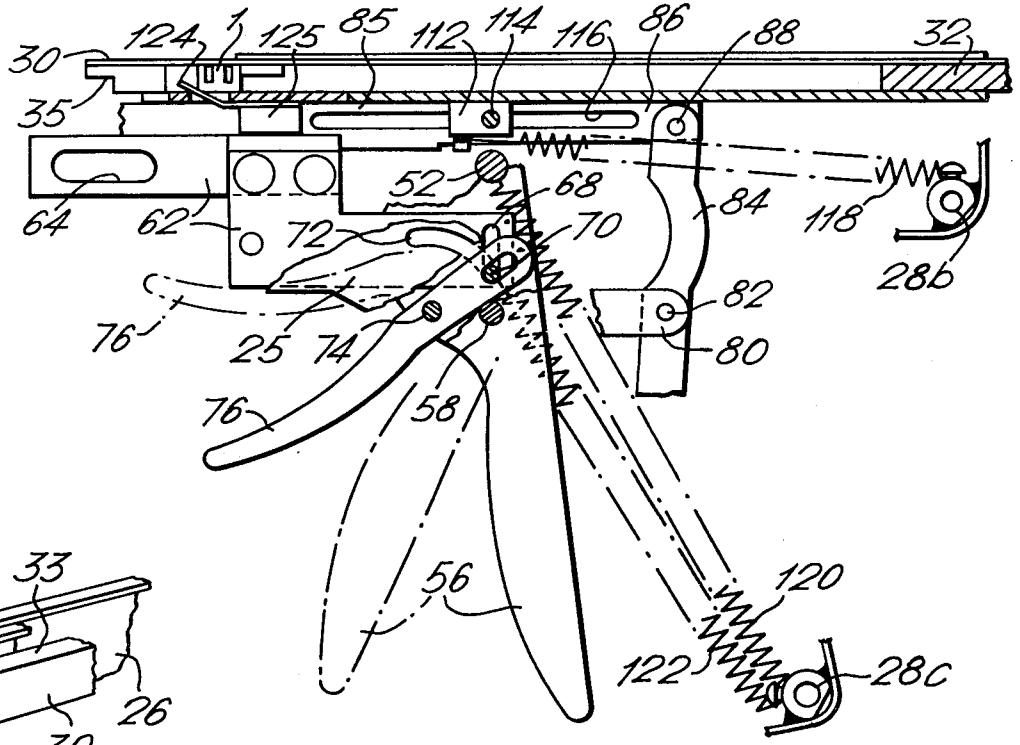
FIG. 10 is a diagrammatic side view illustrating the operation of certain moving parts of the tool.
Figure 11:
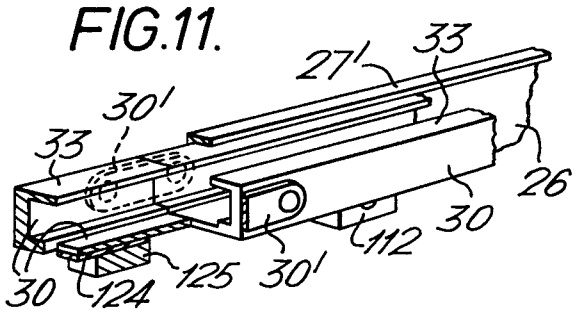
FIG. 11 is a perspective view of a detail of the tool.

The tool, which has the form of piston, comprises a butt portion 25 and a barrel portion 27, formed by side plates 26 rigidly connected in the spaced relationship by means of bolts 28. The upper ends of the slide plates 26 have flanges 27' to receive, slidably, a connector feed track 30 extending longitudinally of the barrel portion 27, and comprising two lengths secured together by links 30' as shown in FIGS. 11. The right hand (as seen in FIGS. 2 and 3), or rear, end of the feed track 30 as slidably receives a connector feed handle 32. The track 30 has upper walls 33 defining a central longitudinal slot. The extreme left hand (as seen in FIGS. 3 and 10) end of the track 30 is under-cut to provide a rectangular notch 35. Forwardly of the track 30, the plates 26 define guides 31 for the feet track 30.

Pivoted to the left hand (as seen in FIGS. 2 and 3), or forward end of the tool, by a pivot pin 34 extending through the plates 26, is a U-cross section connector lid closure jaw 36 having a closure head 38 on one side of the pivot pin 34 and being connected on the other side of the pin 34, by pivot pins 40, to one end of each of links 42 of a pair of two-link toggle linkages one on each side of the tool. The other link 44 of each toggle linkage is connected at one end, to the other end of the link 42 by a pivot pin 46. The other end of each link 44 is connected to a pivot pin 48 slidable along aligned longitudinal slots 49 in the plates 26. The pivot pins 46 are in turn each connected to one end of a link 50 the other end of which is connected to a pivot pin 52 engaging in aligned L-shaped tracks 54 in the plates 26, the pin 52 also passing through the upper (as seen in FIG. 3) end of a first operating trigger 56 mounted on a pivot pin 58 constititing the pivotal axis of the trigger 56 and being received in a pair of opposed elongate slots 60 (FIGS. 2, 5 and 13) formed in the plates 26 and extending longitudinally of the tool.

The pivot pin 48 as well as being slidably received in the opposed slots 49 in the plates 26 is connected to a first slide 62 (as shown in FIG. 6) slidably received between the plates 26 so that the slide 62 can drive the pin 48 along the slots 49. The slide 62 has a slot extending longitudinally of the tool and slidably receiving the pin 34. The slide 62 also has a slot 68 extending at right angles to the slot 64 and slidably receiving a pin 70 which is also slidably received in aligned arcuate slots 72 in the plates 26.

The trigger 56 comprises, as best seen in FIG. 5, a pair of parallel plates. Mounted between these plates on a pivot pin 74, is a second trigger 76 having its inner end, a longitudinal slot 78 slidably receiving the pivot pin 70. Parallel links 80 are connected at one end to the pin 58 and at the other by a pivot pin 82 to parallel operating levers 84 for a bifurcated second slide 86, the levers 84 being connected to the slide 86 by a pivot pin 88 at one end thereof and being connected to the plates 26 at the bottom of the butt portion 25 of the tool through a lost motion connection 90.

The slide 86 carries at its forward end, a connector gripper comprising a fixed jaw 92 having a connector receiving recess 93 and to which is pivoted a movable jaw 94 on a pivot pin 96, the jaw 94 being urged towards the jaw 92 i.e. towards a closed position of the gripper, by a spring 98. Also connected to the pivot pin 96 is a connector lid partial closure member 100 having a working nose 102 on one side of the pin 96 and being connected on the other side of that pin, to one end of a spring 104, the other end of which is connected to one of the bolts 28, reference 28*a,* at the forward extremity of the tool, the spring 104 urging the member 100 in a clockwise (as seen in FIG. 9) direction of rotation about the pin 96. The member 100 has a recess 106 in which a stop bolt 108 fixed between the plates 26 at the forward end of the tool body, is engageable.

The slide 86 is urged in a forward i.e. leftward (as seen in FIG. 3) direction, by a return spring 120 one end of which is secured to one of the bolts 28, reference 28*c* and the other end of wich is secured to the pin 52. Plates 112 riveted to the base of the track 30 carry pins 114 slidably received in longitudinal guide slots 116 in the arms 85 of the slide 86. The plates 112 and thus the track 30 are urged in a rightward direction by a return spring 118 connected at one end to the plates 112 and at the other to one of the bolts 28, reference 28*b.*

The slide 62 is urged in a rearward i.e. rightward direction by a return spring 122 secured to the pin 70 and to the bolt 28*c.* The trigger 56 is urged in a clockwise (as seen in FIGS. 2, 3 and 10) direction of rotation about the pin 58, by the return spring 120 and the trigger 76 being urged in a clockwise (as seen in FIGS. 2, 3 and 10) direction of rotation about the pin 74, by the return spring 122.

A row of connectors 1 is, as shown in FIGS. 3, 10, 12 and 13, arranged in the feed track in side-by-side relationship, with the lids 4 of the connectors in an open position so as to lie parallel to the upper and lower (as seen in FIG. 3) walls of the track 30 and with the leading connector in the track engaging a resilient escapement finger 124 projecting obliquely upwardly (as seen in FIGS. 3 and 10) from a block 125 secured to the base of the track 30. The ribs 19 on the lids 4 of the connectors 1 frictionally engage the upper walls 33 of the track 30.

A cycle of operation of the tool will now be described.

Figure 12:
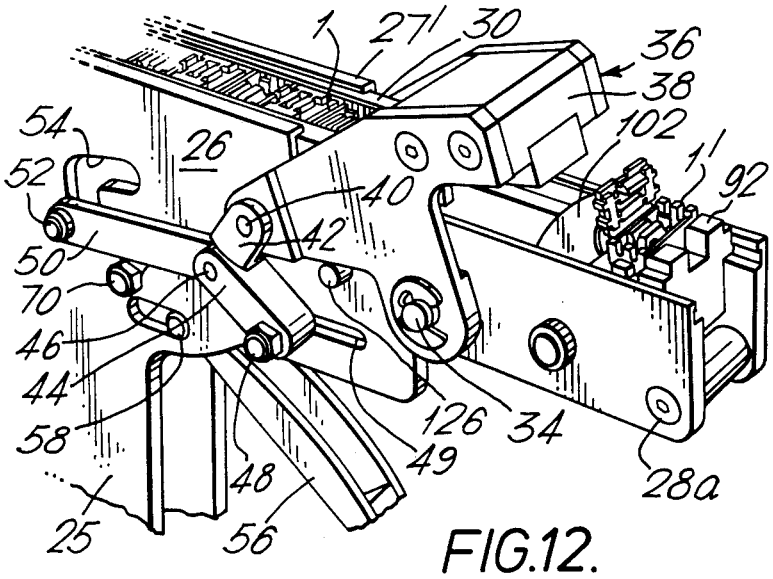
FIG. 12 is a perspective view of the forward end of the tool, at the stage shown in FIG. 2 of its cycle of operation.

FIGS. 2, 10 and 12 show the tool in its loaded condition, with the triggers 56 and 76 undepressed i.e., in their fully clockwise angular positions about their respective pivot pins 58 and 74 (see the broken line trigger positions in FIG. 10). A connector 1' is gripped between the jaws 92 and 94 of the gripper with the slide 86 carrying these jaws in its forward position. The connector 1' was loaded into the gripper at the end of a previous cycle of operation of the tool as will be described below. The slide 62 is in its rearward position as shown in FIGS. 3 and 10, the jaw 36 being in its fully clockwise as seen in FIG. 2 position about the pivot pin 34 to an extent limited by stop studs 126, the toggle linkages constituted by the links 42 and 44 being in a broken positon as shown in FIGS. 2 and 12.

As shown in FIGS. 2 and 12 the lid 4 of the connector gripped between the jaws 92 and 94 is urged into a partially closed position by the nose 102 of the member 100 since in this advanced position of the slide 86, the bolt 108 is engaged in the recess 106 of the member 100 so that the member 100 is retained in an extreme anticlockwise (as seen in FIG. 3) angular position about its pivot pin 96.

The operator now lays the wires to be spliced in the guide groove 16 of the box 2 of the connector 1' so as to lie across the mouths of the slots 10 of the terminal of the connector 1', in the manner described above with reference to FIG. 1.

Figure 13:
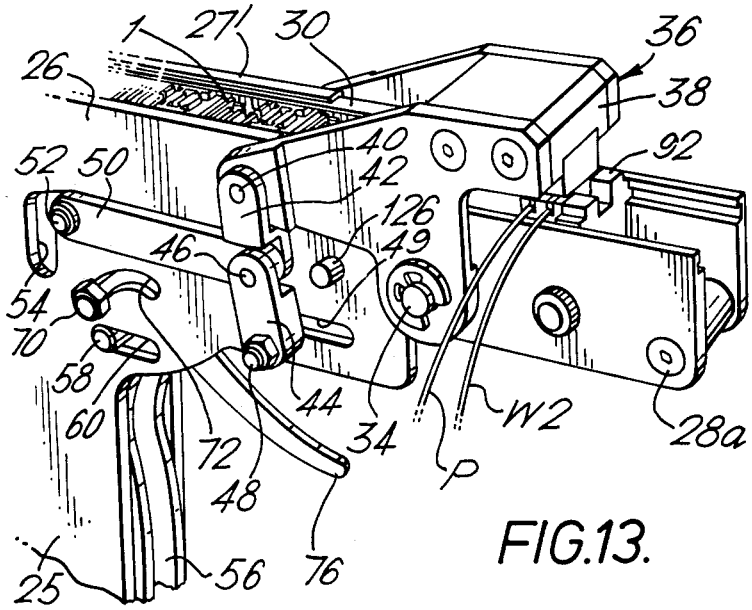
FIG. 13 is a perspective view of the forward end of the tool showing the tool at the stage shown in FIG. 3, of its cycle of operation.

Having thus loaded the connector 1' with wires the operator depresses the trigger 56 from the FIGS. 2 and 12 position to the FIGS. 3 and 13 position, i.e. from the broken line to the full line position in FIG. 10. This brings the trigger 76 from the broken line position in FIG. 10 to the full line position. During the depression of the trigger 56 the slide 86 is moved rearwardly by means of the links 80 and levers 84, to the FIGS. 3 and 10 position. During this movement of the slide 86, the member 100 is disengaged from the bolt 108 so as to be rotated about the pin 96 to the position in which the member 100 is shown in FIG. 9, under the action of the spring 104, whereby the nose 102 is retracted between the plates 26 and below the guides 31. At the same time, the pivot 52 at the top of the lever 66 is moved upwardly and forwardly in the tracks 54 so that the toggle linkages 42, 44 are straightened by the links 50 so that the jaw 36 is rotated about its pivot pin 30 from its FIGS. 2 and 12 position towards its FIGS. 3 and 13 position.

During the retraction of the slide 86 the partially open lid 4 of the connector 1' engages the head 38 of the jaw 36 so that the lid 4 is moved further towards its closed position as the connector 1' is moved beneath the head 38, which, when the jaw 36 has been moved to its FIGS. 3 and 13 position fully closes the lid 4 so that the wires are spliced in the connector 1' in the manner described above with reference to FIG. 1. The parts of the tool are now all positioned as shown in FIGS. 3 and 10 (in full lines).

The operator now depresses the trigger 76 so that the pin 70 rises to the top of the slot 68 and travels along the slots 72 so that the slide 62 is advanced to its forward position. During this advance movement of the slide 62 the pivot pin 48 is carried by the slide 62 to the extreme leftward (as seen in FIG. 3) end of the slot 49 so that the toggle linkages constituted by the links 42 and 44 are again broken, whereby the jaw 36 is raised so that the head 38 is lifted from the closed connector 1. The left-hand (as seen in FIG. 3) end of the advancing slide 62 engages the lowermost extremity of the jaw 94 and thus rotates this jaw in a clockwise (as seen in FIG. 3) direction agains the action of the spring 98 so that the closed connector is released by the jaws 92 and 94, and the jaw 94 is retracted below the guide track 31. The operator is thus enabled to remove the spliced connection formed by the closed connector 1' and the wires, from the tool.

In order to prepare the tool for a further cycle of operation, the operator maintains pressure on the triggers 56 and 76 and advances the feed handle 32 so that by virtue of the frictional engagement between the ribs 19 on the lids 4 of the connectors 1, and the upper walls 33 of the track 30, the track 30 is driven forward against the action of the spring 118, until the fixed jaw 92 is engaged in the notch 35 of the track 30, so that the friction is overcome and the leading connector in the track 30 is advanced over the resilient finger 124 and comes to rest in the recess 93 of the jaw 92, the track 30 being returned to its initial position by the spring 118 when the handle 32 is released.

The operator finally releases both the triggers 56 and 76 so that the other parts of the tool are returned to the FIG. 1 position through the agency of the return springs 98, 120 and 122. As the slide 86 is returned to its advanced position by the spring 120, acting on trigger 56, links 80 and levers 84, the bolt 108 engages in the recess 106 of the member 100 so that the member 100 is returned to the position of FIG. 2 against the action of the spring 104.

It is a particular advantage of the tool described above, that when the connector 1' is to be loaded with wires its lid 4 faces the operator, and the open box 2 is positioned forwardly of the head 38, so that the loading operation is very easily performed. Apart from loading the wires into the connector 1', all the operator has to do, is to depress the triggers 56, and 76 in succession, advance the handle 32, and then release the triggers so that the tool is once again ready for use.

To protect the connectors 1 from the ingress of dirt and moisture, the open top of the slide 30 is preferably covered a further slide (not shown) arranged to fit between the flanges 27' of the side plates 26.

What is claimed is:

1. Apparatus for mating first and second portions of an electrical connector to connect a terminal therein to a wire placed between the portions, the apparatus comprising a support for the first portion, a jaw, means for moving the jaw from a raised portion remote from the support, towards the support, to move the second portion into mating relationship with the first portion, means for displacing the support from a first position remote from the jaw to a second position in register with the jaw when the jaw is in its raised position, and means for positioning the second portion with respect to the jaw prior to the support reaching its second position, to enable the jaw to move the second portion into mating relationship with the first portion.

2. Apparatus according to claim 1, in which the support comprises a gripper having an open position allowing insertion of the first portion into the gripper, and a closed position in which the second portion is gripped by the gripper, means being provided for bringing the gripper to its open position in the second position of the support, such means also serving to return the jaw to its raised position, means also being provided for feeding a connector into the gripper in the raised position of the jaws and with the gripper in its open position.

3. Apparatus according to claim 1, in which the positioning means comprises a positioning member connected to the support and which is interposed between the jaw and the support when the support is in its first position, the positioning member being withdrawn to allow the support to be moved to its second position.

4. Apparatus according to claim 2, in which the support is mounted on a slide which is movable to displace the support between its first and second positions, by means of a hand lever pivotally mounted on a frame of the apparatus, the hand lever being connected to the jaw to move the jaw towards the support in the second position, of the support a second hand lever being connected to a second slide also connected to the jaw, the second slide being movable by the second hand lever to return the jaw to its raised position and to bring the gripper to its open position.

5. Apparatus according to claim 4, in which the jaw is connected to the first and second hand levers through a two-link toggle linkage, the first hand lever being connected to the knee joint of the toggle linkage, and the jaw and the second hand lever being each connected to a link of the toggle linkage at a position remote from the knee joint, the first hand lever being movable to straighten the toggle linkage and the second hand lever being movable to shift its connection with the link of the toggle linkage along a rectilinear path away from the knee joint to break the toggle linkage from its straightened position.

6. Apparatus according to claim 5, in which the first hand lever, is connected to the toggle linkage through a pivot pin which is movable along an L-shaped path to straighten the toggle linkage, the pivotal axis of the first hand lever being movable along a rectilinear path.

7. Apparatus according to claim 5, in which the second hand lever is connected to the toggle linkage through a pivot pin which is movable along an arcuate path to break the toggle linkage and is simultaneously movable along a rectilinear slot in the second side to advance the second slide to move the gripper to its open position.

8. Apparatus according to claim 5, in which the apparatus is in the form of a pistol-shaped hand tool having a butt portion and a barrel portion, the hand levers being in the form of triggers projecting transversely of the butt portion, the second hand lever being pivotally mounted in the first hand lever in such a way that the first hand lever is depressible towards the butt portion by a hand grasping the butt portion, prior to depressing second hand lever.

9. Apparatus according to claim 1, which is constructed for use with an electrical connector of which the first first portion consists of an insulating box containing the terminal, the second portion of the connector consisting of a lid hinged to the box and in which the positioning means serves partially to close the lid, a working head on the jaw abutting the lid as the support is moved towards the second position further to close the lid, the head serving fully to close the lid as the jaw is moved towards the support.

10. Apparatus according to claim 1, in which a connector feed track is advanceable towards the support, to an extent limited by a stop, to position a connector in the support when the support is in its second position and the jaw is in its raised position.

11. Apparatus according to claim 10, in which the support comprises a fixed jaw and a movable jaw, the feed track having a recess in which the fixed jaw engages, in the fully advanced position of the feed track, to limit the advance thereof.

12. Apparatus according to claim 10, in which the feed track is advanced by means of a feed member which is slidable in the feed track to engage a row of connectors in the feed track, which connectors frictionally engage the feed track, the engagement of the feed track with the stop causing a connector to be ejected from the feed track into the support.

13. Apparatus according to claim 12, in which the connectors are retained in the feed track by means of a resilient escapement finger projecting into the feed track at its end nearest to the support.

14. Apparatus according to claim 10, in which the feed track, which comprises a plurality of channel-shaped elements connected together in end to end relationship by means of links, is advanceable against the action of a return spring.

15. A pistol-type tool for mating first and second portions of an electrical connector to connect a terminal therein to a wire placed between the portions, the tool comprising a forward end, and rear end, a support for the first portion, a jaw intermediate said forward and rear ends, means for moving the jaw from a raised position to a closed position, to move the second portion into mating relationship with the first portion, means for displacing the support rearwardly from a first position and at the forward end of the tool to a second position in register with the jaw when the jaw is in its raised position, and means for positioning the second portion with respect to the jaw prior to the support reaching its second position, to enable the jaw to move the second portion, into mating relationship with the first portion as the jaw is moved to its closed position.

* * * * *